US006454692B2

(12) United States Patent
Ganneval et al.

(10) Patent No.: US 6,454,692 B2
(45) Date of Patent: Sep. 24, 2002

(54) METHOD AND DEVICE FOR PERFORATING MATERIAL WEBS

(75) Inventors: Bernard Ganneval, Paris; Pierre Hoynant, Neuilly sous Ciermont, both of (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/789,792

(22) Filed: Feb. 20, 2001

Related U.S. Application Data

(63) Continuation of application No. PCT/EP99/05645, filed on Aug. 4, 1999.

(30) Foreign Application Priority Data

Aug. 18, 1998 (FR) ..... 98 10502
Jul. 8, 1999 (DE) ..... 199 31 917

(51) Int. Cl.[7] ..... B31F 1/08; B31F 1/10
(52) U.S. Cl. ..... 493/424; 493/363
(58) Field of Search ..... 493/363, 366, 493/365, 371, 372, 424, 426, 359; 83/660, 837, 848

(56) References Cited

U.S. PATENT DOCUMENTS 3,228,710 A 1/1966 Chodorowski
3,999,454 A * 12/1976 Tiso et al. ..... 83/107
4,564,470 A * 1/1986 Schmitt ..... 493/324
4,951,967 A * 8/1990 Michalik ..... 83/660
5,072,919 A * 12/1991 Schneider et al. ..... 493/426
5,367,936 A * 11/1994 Held et al. ..... 83/698.61
5,443,437 A * 8/1995 Mack ..... 493/359
5,494,270 A * 2/1996 Laubscher ..... 493/429
5,524,930 A 6/1996 Foster et al.
6,010,122 A * 1/2000 Weber ..... 493/359

* cited by examiner

*Primary Examiner*—John Sipos
*Assistant Examiner*—Hemant M. Desai
(74) *Attorney, Agent, or Firm*—Laurence A. Greenberg; Werner H. Stemer; Ralph E. Locher

(57) ABSTRACT

A method of producing folds on signatures separated from a material web stream, including a multilayer material web stream, includes the method steps of disposing two cutting and perforating devices, respectively, in a web travel direction; cutting the material web stream in the region of a first longitudinal fold by a first cutting device assigned to the fold; perforating/cutting the material web stream in the region of a crossfold forming material bridges; and providing that at least one of the cutting or perforating tools is adjustable in relation to the material web stream. The invention also includes a device for performing the method; and a folder, and more specifically, a pinless folder having the device.

22 Claims, 6 Drawing Sheets

METHOD AND DEVICE FOR PERFORATING MATERIAL WEBS

CROSS-REFERENCE TO RELATED APPLICATION

This application is a continuation of copending International Application No. PCT/EP99/05645, filed Aug. 4, 1999, which designated the United States.

BACKGROUND OF THE INVENTION

FIELD OF THE INVENTION

The invention relates to a method of folding printed materials lying above one another in a crossfold, in particular for folding paper webs used for producing printed products, cutting devices being used to perform the method.

During longitudinal folding and crossfolding, i.e., the crosswise folding of printed materials lying above one another, tensile forces act upon the outside of the printed material, while compressive forces act upon the inside thereof. As a result, in the vicinity of the cutting point of the folds which are produced in succession and run transversely with respect to one another, creases are formed, and a displacement of the pages of the signature produced by the folding operation occurs.

In the printing industry, various folders are known wherein paper webs lying one above another are folded. Web-fed rotary printing machines generally include a folder which has at least one folding unit wherein the printed material is folded longitudinally, and a folding unit wherein the printed material is folded transversely, i.e., at right angles to the first fold. The printed materials to be folded may be either material webs or web strands which have previously been cut from the web in the longitudinal direction. During the production of folded sheets or signatures, the use of such folders inevitably leads to the formation of creases at the cut point of the folds, by which the printed image is impaired, in that under certain circumstances individual letters become hidden and, because of the waviness, the perception of the printed image is changed. In addition, displacement of the individual pages in the interior of the signature occurs, and also, subsequently, displacement of the position of the pages as a whole, on account of the increase in volume. The points at which the creases occur are consequently thicker than the rest of the signature, which leads to problems when a large number of signatures are to be separated again for subsequent further processing. Deformation of the separating device even occurs often during the separating operation. In addition, this thickening of the signatures has the effect of thickening the finished printed product, which includes a large number of signatures.

The detrimental effect of these creases is all the greater the more pages there are in a signature and the thicker the paper that is used. Accordingly, it is hardly possible to produce signatures with 32, 48 or more pages from relatively thick paper, so that the page count of such signatures has to be restricted to 24, 16 or even 8 pages. The creases produced in the crossfold during folding therefore have visible, practical and financial consequences. By avoiding the creases, the visual effect of the printed products is improved, which leads to greater satisfaction among customers and readers. In addition, further processing is made easier, because the geometric position of the signatures, and therefore also of the finished product, is improved. In addition, increased economy of the production process of printed products can be achieved because signatures with a high page count can be produced even with relatively thick paper, without having to reduce the production printing speed or the further processing speed.

U.S. Pat. No. 3,228,710 is concerned with the perforation of a section of paper sheets which have been folded longitudinally and transversely. The perforations run halfway over the width of the sheets, inclined at a first angle and, in addition, the perforation can extend over the width of the sheets on both sides of a line of symmetry, the inclinations of the perforation slits being opposed to one another. The perforating knives for making the perforation are fitted to a cylinder which cooperates with a grooved-bar cylinder serving as a counter-cylinder.

U.S. Pat. No. 4,951,967 discloses a perforating knife which is inserted into a sprung mounting in a grooved cylinder. According to the disclosure, the perforating knife is provided with teeth which are fitted with lateral flat pieces which, in an alternating sequence, are alternatingly oriented upwardly or downwardly. The perforating knife is clamped between two clamping bars which, in turn, are inserted in a sprung manner into a common housing in the perforating cylinder.

U.S. Pat. No. 5,524,930 likewise relates to a perforating knife and a signature perforated by this perforating knife. The knife, having mutually inclined teeth, is accommodated in a mounting in the cylinder and has both rounded parts and angular perforating sections. With the aid of the angular and the rounded perforating sections, both curved and slightly curved perforation slits, and also perforations running in a straight line, are produced in the signature.

Attempts have already often been made to avoid creases and to eliminate their consequences, for example, by having the fold, which is subsequently crossed by a further fold, perforated or cut into in a complicated manner over the entire length thereof or only partially. These methods require, to some extent, the use of comprehensive and costly devices and, although they reduce the creases and/or displace them to a different point on the folded printed product, they are not able to solve the problem in a satisfactory manner. In addition, creases are formed, and the position of the pages is displaced.

SUMMARY OF THE INVENTION

In view of the foregoing prior art, it is accordingly an object of the invention to provide an improvement in the folding accuracy of multi-layer folded signatures by previous sectional perforation of the signatures.

With the foregoing and other objects in view, there is provided, in accordance with one aspect of the invention, a method of producing folds on signatures separated from a material web stream, including a multilayer material web stream, which comprises the method steps of disposing two cutting and perforating devices, respectively, in a web travel direction; cutting the material web stream in the region of a first longitudinal fold by a first cutting device assigned to the fold; perforating/cutting the material web stream in the region of a crossfold forming material bridges; and providing that at least one of the cutting or perforating tools is adjustable in relation to the material web stream.

In accordance with another mode, the method of the invention includes providing that one of the perforating/cutting devices be adjustable in terms of angle of attack in relation to the material web stream.

In accordance with a further mode, the method of the invention includes providing that one of the perforating/cutting devices be adjustable in terms of penetration depth in relation to the material web stream.

In accordance with an added mode, the method of the invention includes providing that one of the perforating/cutting devices be displaceable in vertical direction in relation to the material web stream.

In accordance with an additional mode, the method of the invention includes providing that a second perforating/cutting device begin a delayed cutting and perforation operation, respectively, in relation to a first cutting device.

In accordance with yet another mode, the method of the invention includes providing that a delayed perforation and cutting operation, respectively, be completed by a further perforating/cutting device by generating the first crossfold.

In accordance with yet a further mode, the method of the invention includes detaching established material bridges in the region of the first crossfold during the completion of the folding operation.

In accordance with yet an added mode, the method of the invention includes detaching the material bridges by thrust forces occurring in the interior of the material web stream.

In accordance with yet an additional mode, the method of the invention includes providing that the material bridges constitute intended rupture points having a thickness determined by the configuration of the perforating/cutting tool.

In accordance with still another mode, the method of the invention includes selectively operating the cutting device and cutting/perforating device simultaneously and separately from one another, respectively.

In accordance with another aspect of the invention, there is provided a device for producing folds in signatures which are separated from a material web stream, including a multilayer material web stream, having a first longitudinal folding device for producing a first longitudinal fold, and a folding cylinder for producing a crossfold, comprising an infeedable cutting device for cutting the material web stream along the first longitudinal fold, and a further perforating/cutting device disposed downline therefrom, and being provided with regions for at least one of perforating the material web stream and cutting the material web stream, respectively.

In accordance with a further feature of the invention, the infeedable cutting device accommodates a movable cutting tool.

In accordance with an added feature of the invention, the cutting tool is adjustable in terms of the angular position thereof in relation to the material web stream.

In accordance with an additional feature of the invention, the perforating sections extend over the entire length of the perforating/cutting tool.

In accordance with yet another feature of the invention, the cutting sections extend over the entire length of the perforating/cutting tool.

In accordance with yet a further feature of the invention, the cutting and perforating sections, respectively, extend halfway along the perforating/cutting tool.

In accordance with yet an added feature of the invention, the fold-producing device includes a fold cut point on the perforating/cutting tool for determining the position of the second longitudinal fold on the signature.

In accordance with yet an additional feature of the invention, cutting surfaces are formed with different lengths in the longitudinal direction of the perforating/cutting tool.

In accordance with still another feature of the invention, cutouts formed on the perforating/cutting tool determine the configuration of the material bridges and subsequent intended rupture points on the signature.

In accordance with still a further feature of the invention, the first longitudinal folding device, a further perforating/cutting device and a possibly provided second longitudinal folding device are movable transversely with respect to the web travel direction by drives, and also included are contact transmitters for detecting the position thereof.

In accordance with an additional aspect of the invention, there is provided a folder having a device for producing folds in signatures which are separated from a material web stream, including a multilayer material web stream, having a first longitudinal folding device for producing a first longitudinal fold, and a folding cylinder for producing a crossfold, comprising an infeedable cutting device for cutting the material web stream along the first longitudinal fold, and a further perforating/cutting device disposed downline therefrom, and being provided with regions for at least one of perforating the material web stream and for cutting the material web stream, respectively.

In accordance with a concomitant aspect of the invention, there is provided a pinless folder having a device for producing folds in signatures which are separated from a material web stream, including a multilayer material web stream, having a first longitudinal folding device for producing a first longitudinal fold, and a folding cylinder for producing a crossfold, comprising an infeedable cutting device for cutting the material web stream along the first longitudinal fold, and a further perforating/cutting device disposed downline therefrom, and being provided with regions for at least one of perforating the material web stream and for cutting the material web stream, respectively.

The invention is thus based upon two basic ideas. The first includes the fact that the printed and folded signatures presently produced in the printing industry are folded twice, often even three times or more in a crossfold. Although it is often necessary to keep the folds produced in order to permit the subsequent further processes, which are presently performed at higher and higher speeds because of increasing automation, it is not absolutely necessary to keep all of the folds. Accordingly, a precise analysis of the requirements of the further processing processes must be undertaken. The second idea is based upon the fact that the creases are produced because the individual pages of the signature are connected to one another and remain joined even after the folding operation, tensile and compressive forces acting in opposite directions in the fold at the point of intersection with the preceding fold and caused by the bending of the stack meeting one another, so that a thrust force is produced and the pages shear off. Consequently, if the joint between the individual folded pages is detached at those points at which the presence of a fold is not absolutely necessary for further processing, then the creases are reduced. Consequently, the fold which has as its main task to place the pages of the signatures onto one another in increasing order in a repetitive operation, and in this way to produce the desired number of signatures, does not need to be kept permanently if it is not necessary for the subsequent processing operations.

For this purpose, the invention of the instant application provides a first cutting device, which is arranged underneath the lower tip of the folding former, and by which the first fold, extending longitudinally, is cut, in order as a result to prevent any undesired displacement of the paper web during the forward movement thereof. The first, longitudinally extending fold therefore only appears to exist; it is actually only present for as long as is necessary to align the relevant pages correctly. The web streams laid on one another in this way are no longer joined to one another and can consequently be crossfolded without creases being produced because, by lateral movement, they are able to give way to the tensile and compressive forces acting thereon.

In addition, the invention of the instant application provides a second device which produces a delayed cut. This device concerns a knife which has a number of cutting sections, and perforating teeth arranged alternatingly beside one another in a row. This device is used like a conventional perforating knife and employed to perforate the line on which the first fold runs, the penetration depth of the perforating knife depending upon the thickness of the layers lying on one another, and the perforating knife cooperating with a conventional known counterpressure element. Accordingly, the device permits the paper layers lying on one another to be cut and, nevertheless, to remain joined at some connecting points provided by the perforating teeth. The profile and the height of the teeth and, if appropriate, the regulation of the penetration depth of the device determine the length of the connecting points, depending upon the printed product to be produced and the paper used. At the time of the first folding operation of the streams lying on one another, the connecting points produced by the perforating teeth have the effect that the first fold is kept and the layers remain joined to one another. The streams can therefore be folded and subsequently transported, by conventional transport equipment, to the following folder, where they are folded transversely with respect to the first fold. During the second folding operation, wherein a fold is produced which runs transversely with respect to the first fold, previously processed by the device according to the invention, tensile and compressive forces which act in opposite directions are produced in the streams lying above one another and, at the point where they meet one another, produce a thrust force which depends upon the thickness of the stack multiplied by 3.1416 and upon the properties or characteristics of the paper being used. In the process, each of the connecting points produced by the device according to the invention becomes an intended rupture point, having dimensions which depend upon the penetration depth of the perforating teeth. In this way, the connection between the individual pages is released, so that they can be displaced laterally without producing any creases. Accordingly, the second device according to the invention begins a cutting operation which is only completed during the second folding operation. This fold, too, is only an apparent fold, which is actually present only for the time during which the paper streams move from the first folder to the following folder.

The two devices according to the invention accordingly permit a method of avoiding creases and the effects thereof, such as irregularities and thickenings of the signatures and finished printed products, difficulties during the handling of the signatures during the further processing, and restricting the page count of the signatures of relatively thick paper crossfolded many times. Assuming appropriate technical development, the method can also be used with other cutting devices, for example, water under high pressure, ultrasound, lasers and the like. The method, both in the embodiment described hereinabove and with alternative cutting devices, also permits the exact mathematical calculation of the graphical breakdown of each page of the signature and of the finished product. It is therefore also possible for novel imposition software to be produced which, in order to determine the final positioning of the pages after the lateral displacement thereof during the folding operation, takes into account the thickness of the paper that is used.

In a first embodiment of the invention, the first cutting device is disposed underneath the lower tip of the folder of the web-fed rotary printing machine, by which the first folding operation in the longitudinal direction is performed. The first cutting device may comprise, for example, a cutting knife or a cutting roller and be fixed in a holder in such a way that the height, the angle of attack and the penetration depth can be regulated. The holder can be pivotably mounted, so that the cutting device can be taken into and out of operation as required. The entire arrangement must have adequate stability in order to withstand the mechanical forces which, under certain circumstances, are produced when tearing the paper. The blade of the first cutting device is fixed during operation and, accordingly, is exposed to wear caused by the mineral constituents of the paper and also high temperature stresses arising from the high speed of the paper moving through the folder. For this reason, the blade can be arranged to be interchangeable, in order to ensure a constantly high cutting quality. The blade can be formed, for example, of treated steel 1 mm thick and can have a two-sided grinding angle of 20°, and can be arranged in a rail by which the blade can be moved into the desired position and firmly clamped. The holder can comprise a metal base which is firmly fixed to the frame of the printing machine, underneath the lower tip of the folding former, and can have a pivotable metal arm which permits the angle of attack to be regulated and also permits the cutting device to be taken out of operation.

The second device according to the invention can be constructed in such a way that it acts over the entire length of the relevant first fold. In this case, the position of the cut point of the second fold must correspond to an actual cut which, on both sides of the cut point of the folds, extends over a length of, for example, twenty times the thickness of the pages laid on one another by the first folding operation.

However, the second device can also be constructed so that it acts only on one side of the first fold. In this case, the actual cut can extend only on one side of the envisaged cutting point of the folds, while on the other side of the cut point, the device has neither a cutting face nor perforating teeth, which may be imperative for the subsequent processing operations of the printed product. The length of the actual cut can be, for example, twenty times the thickness of the pages laid on one another by the first folding operation, or can be some other length of this order of magnitude.

This second device according to the invention can, moreover, be constructed so that the position thereof is displaceable laterally, in order to use it optimally. For this purpose, the fixing openings can have hollowed-out sections which, in addition, permit the sides of the cutting device to be interchanged, which may be necessary in folders of specific construction and for specific further processing methods.

The second device according to the invention can be fabricated from metal or any other desired material suitable for the production of knives. However, the method can also be developed further in accordance with the development of new cutting techniques.

Other features which are considered as characteristic for the invention are set forth in the appended claims.

Although the invention is illustrated and described herein as embodied in a method and device for perforating material webs, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
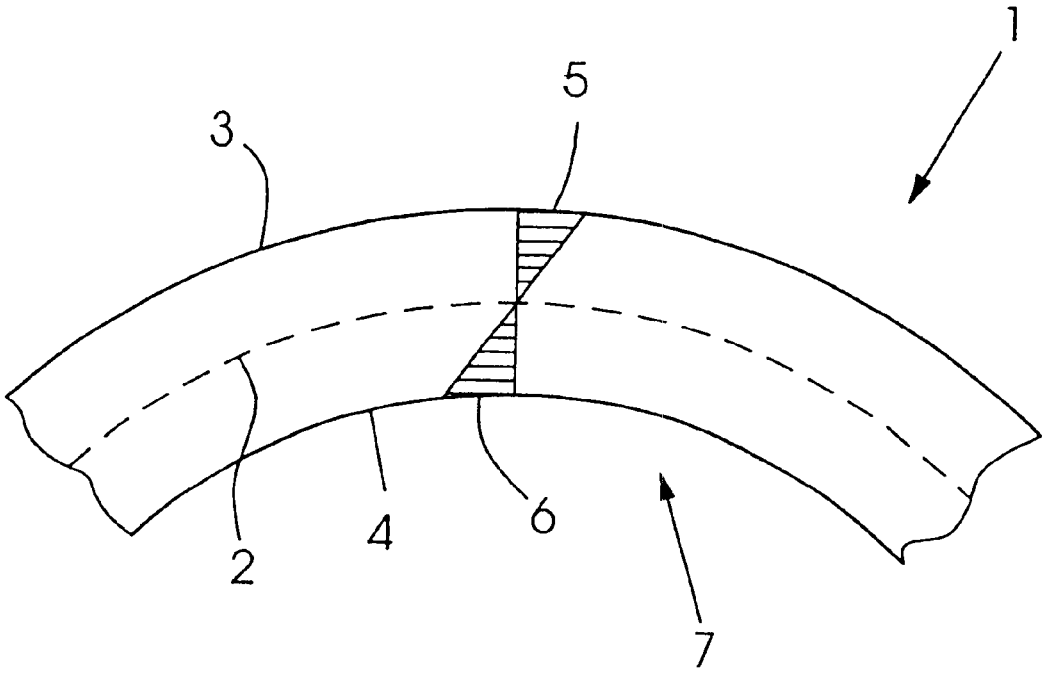
FIG. 1 is a plan view of a fragmentary multilayer web strand and a diagram showing the course of the varying stress therein during a deflection.

Referring now to the drawings and, first, particularly to FIG. 1 thereof, there is reproduced therein the stress relationships established in a multilayer material web during a curvature of the web.

A material web stream or strand 1, made up of web streams or strands led together in a turner-bar superstructure, experiences a deformation illustrated in FIG. 1 during a deflection 7. At the upper side 3 of the material web stream 1, tensile forces 5 occur, while the material web stream 1 is compressed on the underside 4 thereof, which causes compressive forces 6 to be formed in the material, i.e., paper in the example of FIG. 1. In the region of the neutral plane, which runs centrally through the material web stream 1, the force resulting from the deflection 7 is just zero. The deflection 7 can be caused by the curvature of the material web stream 1 around a guide roller, or by the application of a fold, whether a longitudinal fold or a crossfold, in the material web stream 1.

Figure 2:
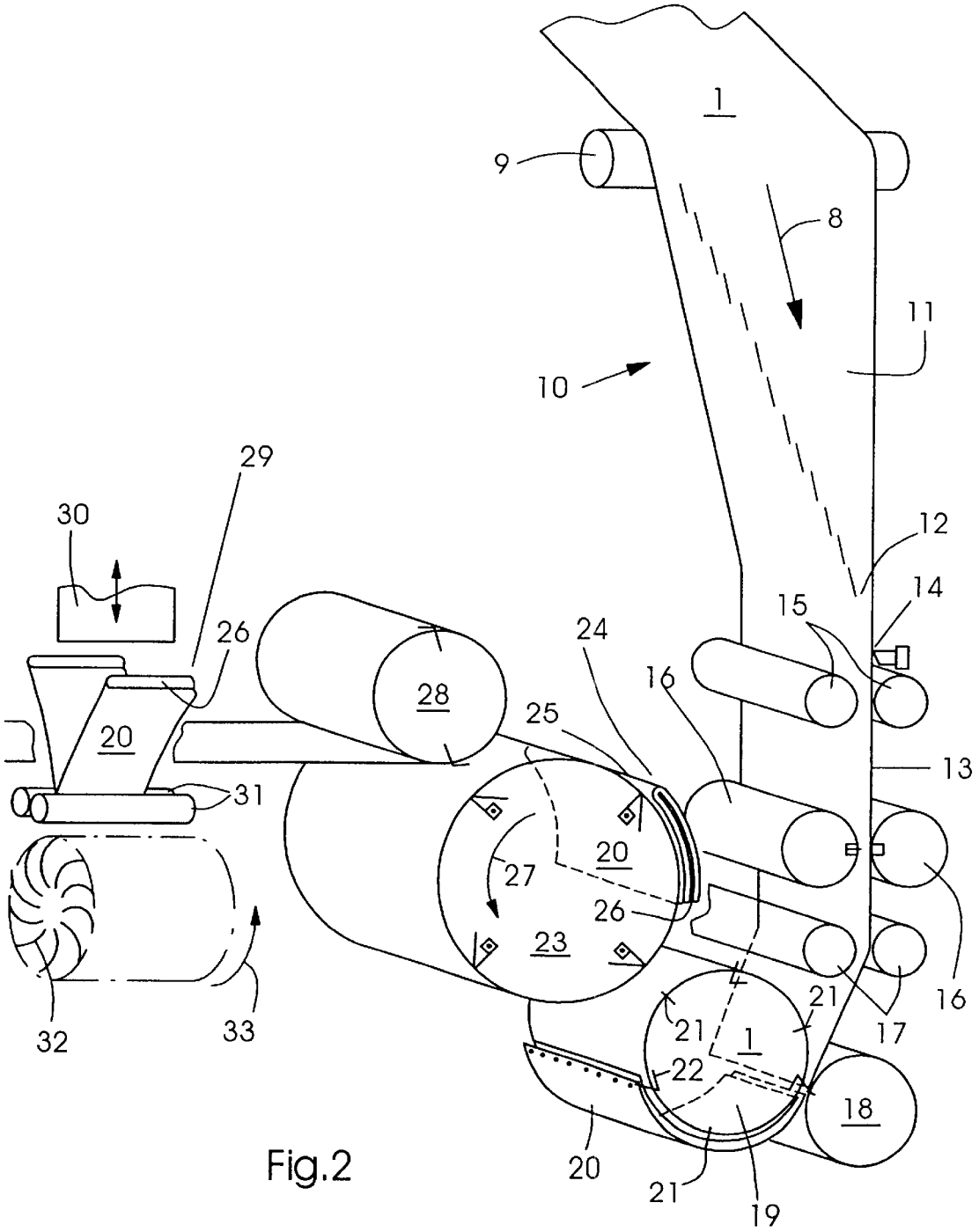
FIG. 2 is a diagrammatic perspective view of a folder depicting the folding operations proceeding therein on a signature separated or severed from the material web.

FIG. 2 shows the folding operations proceeding in the folder on a signature separated from the material web.

The material web stream 1 runs into a first longitudinal folding device 10 in a web travel direction 8, transported over a former inlet roller 9. As early as during the passage through the former inlet roller 9, the deformations illustrated in FIG. 1 occur in the material web stream 1 as a result of which relative displacements can occur between individual web streams in the material web stream 1. The material web stream 1 passes a former plate 11 and, after passing a former nose 12 of the former plate 11, is folded in half longitudinally, i.e., is provided with a folding spine 13 of the first longitudinal fold.

After passing the former nose 12 of the former plate 11, the material web stream 1 provided with the first longitudinal fold 13 passes along a first perforating/cutting device 14 into a pull roller-pair 15, which keeps the material web stream 1 under constant tension. The partially perforated/cut material web stream 1 then passes a second perforating/cutting device 16, whereat the perforation is further formed. Downline of a further pull roller-pair 17, a signature 20 is severed from the material web 1. The folded signature 20, respectively, severed from the leading end of the material web 1 is held on the periphery of a folding-blade cylinder 19 by gripper devices 22, shown here as pins, for example. Instead of pins 22, in the case of folders operating without pins, a series of belts holding the folded signature 20 can be provided in the periphery of the cylinders 19 and 23, replacing the pins 22 which grip the folded signature 20 and pin it on. The folding blades 21 provided on the folding-blade cylinder 19 push the signatures 20 approximately centrally, depending upon the overfold that is provided, into folding jaws 26 which are located opposite the folding blade 21 in the transfer gap or nip between the folding-jaw cylinder 23 and folding-blade cylinder 19. While the folding blades 21 push the signature 20 into the open folding jaws 26 on the folding-jaw cylinder 23, the ends 26 of the folded signature 20 on the periphery of the folding-blade cylinder 19 are released, so that a signature transfer can be performed. The crossfolded signatures 20 are then transported, with the folding spine 25 of the first crossfold 24 leading, on the periphery of the folding-jaw cylinder 23, which rotates in the rotational direction 27.

From the periphery of the folding-jaw cylinder 23, the signatures 20 are picked up by a transport cylinder 28, with which crossfolded signatures 20 are transferred to a second longitudinal folding device 29. A folding blade 30 moving up and down in the direction of the associated double-headed arrow pushes the signatures 20 into a pair of folding rollers 31, underneath which a paddle wheel 32 can be arranged, having pockets which the signatures 20, now provided with a second longitudinal fold, then enter and, in a signature delivery not specifically illustrated here, pass on to further processing.

The material web stream 1 therefore first passes the first cutting device 14 with which the longitudinally folded material web stream 1 is cut along the first longitudinal fold 13, the cutting tool being adjustable in relation to the penetration depth thereof into the material web stream 1 and an angle of attack on the latter, as will be explained hereinafter in greater detail in connection with FIG. 3. Accommodated in the cutting/perforating device 16 arranged downline of the first pull roller-pair 15 are combined perforating/cutting tools which provide the material web stream 1 provided with the first longitudinal fold 13 with a sectional perforation or incision at the point where the signature 20 will subsequently be provided with the first crossfold 24. However, the perforation/incision applied by the perforating/cutting tool 16 is not made completely. There remain, between the perforations, so-called material bridges which, when the first crossfold 24 is performed, become intended or reference rupture points so that movement of the individual pages of the signatures 20 relative to one another is still possible. As it runs into the second perforating/cutting unit 16, the material web stream 1 is cut along the first longitudinal fold, the cross perforation being partially formed in the second perforating/cutting unit 16, along the first crossfold 24.

Figure 3:
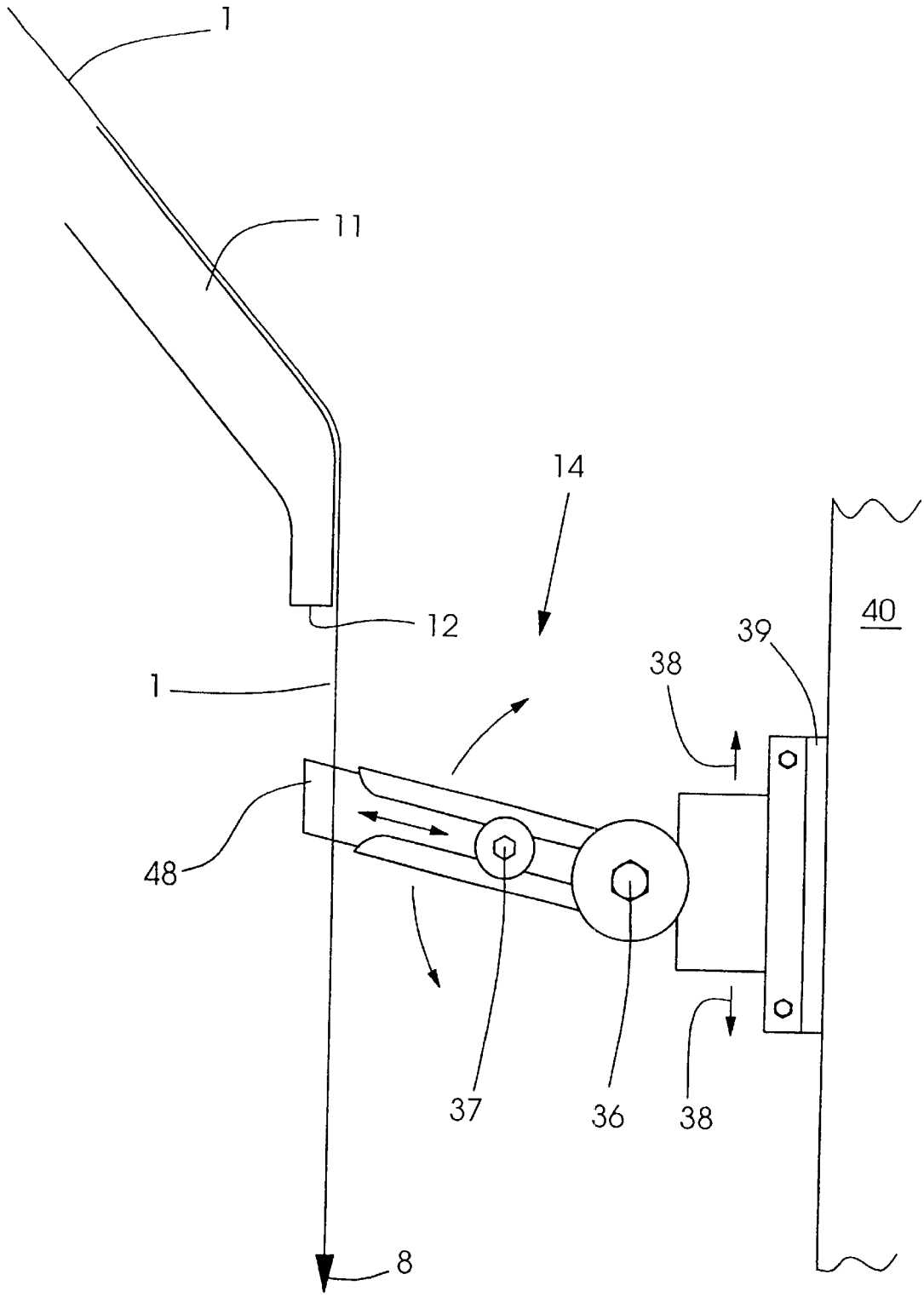
FIG. 3 is a diagrammatic side elevational view of the cutting device according to the invention, which is disposed above a cutting-cylinder pair.

FIG. 3 shows the cutting device 14 which is associated with the first longitudinal fold 13 and in relation to which the further perforating/cutting device 16 applies a delayed cut or a delayed perforation.

Cuts performed by the first cutting device 14 cut the material web stream 1 along the first longitudinal fold 13, so that during a crossfolding operation which is performed later, movements of the web layers relative to one another are possible, and the latter can give way to tensile and compressive forces which occur. This avoids creases on the finished signature 20, in particular, in the case of relatively high page counts, such as 48 or 64 or even 96 pages. FIG. 3 also reveals that the first cutting device 14 can be accommodated on a slide 39 which is movable in the vertical direction 38 and can be moved up and down on the support 40. On a mounting 36, the cutting tool 48 can be adjusted in terms of its angle of attack in accordance with the double-headed arrow, while the cutting tool 48 can be adjusted in the guide therefor in relation to the penetration depth thereof on a mounting 37. As a result, the penetration depth of the cutting tool 48, and therefore the adaptation of the cutting depth, can be set to the thickness of the material web stream 1. The cutting tool 48 can be enclosed on both sides by the guide, the cutting edge thereof being located in the upper region thereof.

Figure 4:
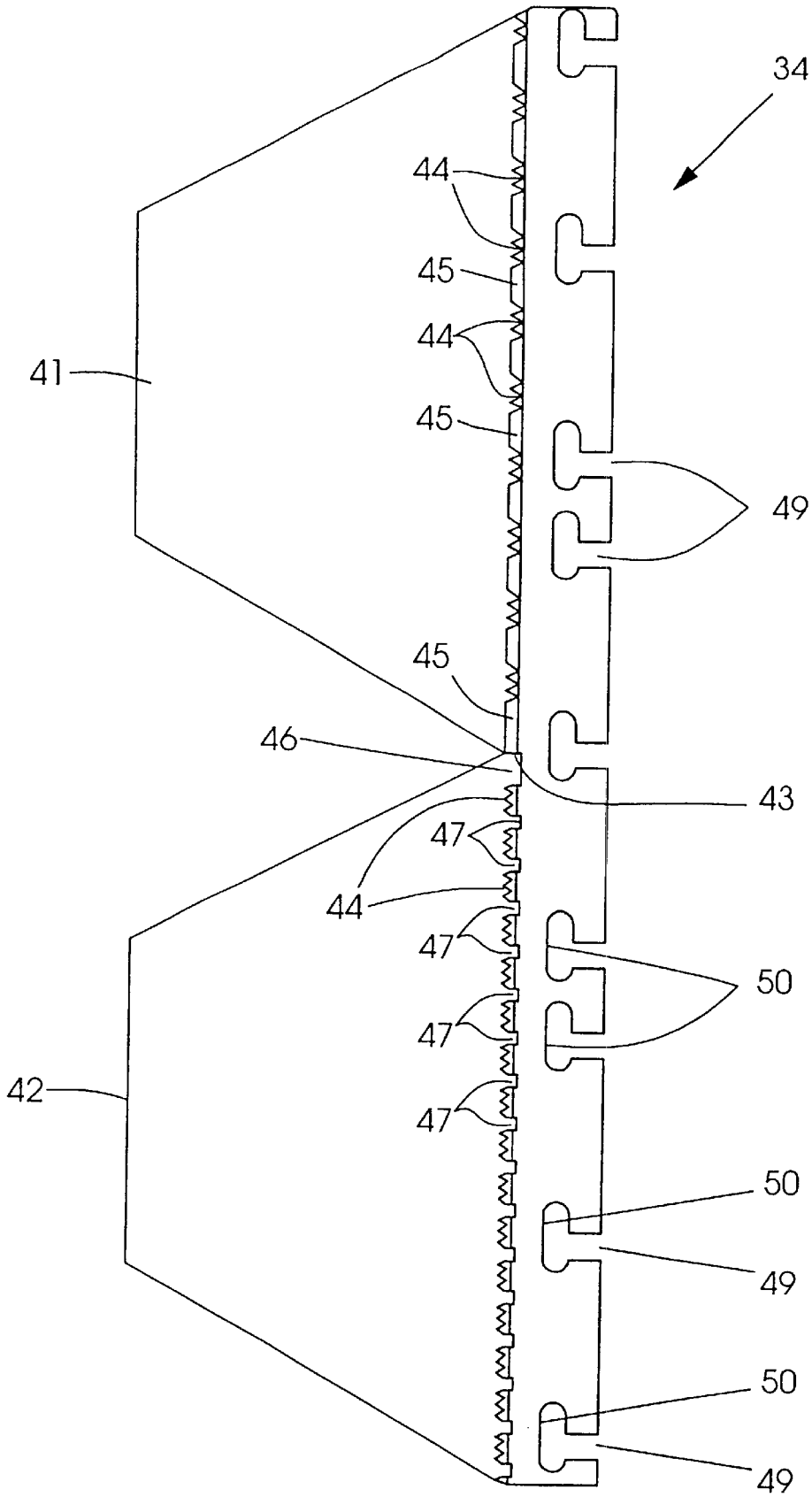
FIG. 4 is a diagrammatic plan view of a perforating tool according to the invention.

FIG. 4 illustrates a perforating/cutting tool 34 which is inserted into one of the cylinders of the further perforating/cutting device 16 and cooperates with a grooved bar mounted on the opposing cylinder in order to form the perforation. In order to form half a perforation along the longitudinally folded material web stream 1, the perforating/cutting tool 34 can be provided with a perforating section 42, while the remaining section 41 of the tool 34 has both cutting sections 45 and perforating sections 44. The perforating/cutting tool 34 has at the center a fold cut point 43, which is bounded on the lefthand side by a cutout 46 and on the righthand side by a longer cutting section 45 of the cutting region 41 on the perforating/cutting tool 34. The position 43 on the perforating/cutting tool 34 defines a central position (note FIG. 7). The central position can be displaced, for example, by displacing the perforating/cutting tool in the translational direction, because the perforating/cutting tool 34 can be mounted in elongated openings or slots 50 which open into mounting openings 49. Depending upon the position of the perforating/cutting tool 34 relative to one of the cylinders of the further perforating/cutting device 16, the position of the perforations or that of the subsequent intended rupture points can be varied between the pages of the signature 20. According to the embodiments at hand, the longitudinal cut produced by the first cutting device 14 runs along the first longitudinal fold 13, exactly through the fold cut point 13 according to FIG. 3. In a modified embodiment of the perforating/cutting tool 34 which is shown, an actual cut in the material web stream 1 is made only in a region 41, while only one perforation is made in the section 42.

Figure 5:
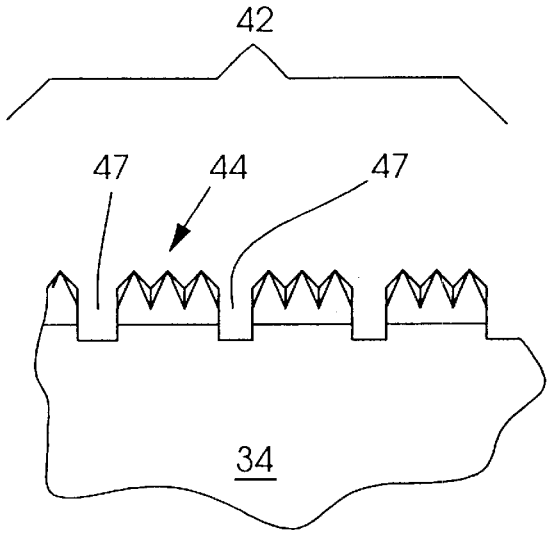
FIGS. 5 and 6 are different enlarged fragmentary views of FIG. 4 showing details of the perforating knife.
Figure 6:
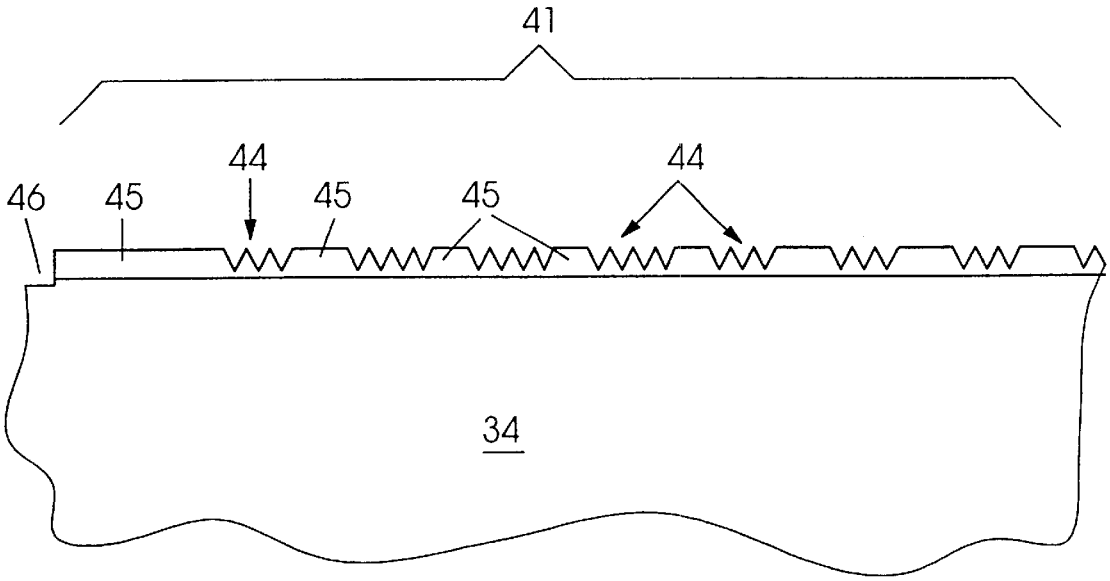

The cutting and perforating sections 41 and 42 of the perforating tool 34 are illustrated and described in greater detail in FIGS. 5 and 6.

The perforating teeth 44 accommodated in the perforating section 42 are, for example, combined into groups of 3, between which individual non-cutting sections 47 are accommodated, forming the material web bridges which initially still connect the signatures to one another before the thrust forces which occur during the crossfolding have the effect that these regions of the material become intended rupture points and are detached. During crossfolding, the connection between the individual pages is detached, so that lateral displacement of the individual pages in relation to one another can take place, and creases which arise there can be avoided. In order to execute the perforations, tools configured in a different way can also be used which, for example, accommodate perforating teeth 44 combined into groups of two. The intended rupture points which are later detached are established based upon the selected configuration of the non-cutting sections 47 on the perforating/cutting tool 34.

The sequence of cutting regions 45 and perforating sections 44 in the cutting section 41 on the perforating/cutting tool 34 is illustrated in FIG. 6. Therein, the fold cut point 43 is located between the cutout 46 and the cutting regions 45 extending along the tool 34. The illustrated perforating teeth 44 are combined into groups of two and three, respectively. The profiling and height of the perforating teeth 44 and of the cutting teeth 45, and the regulation of the penetration depth, determine the length of the material web bridges, depending upon the printed product to be produced and the printing material used.

Figure 7:
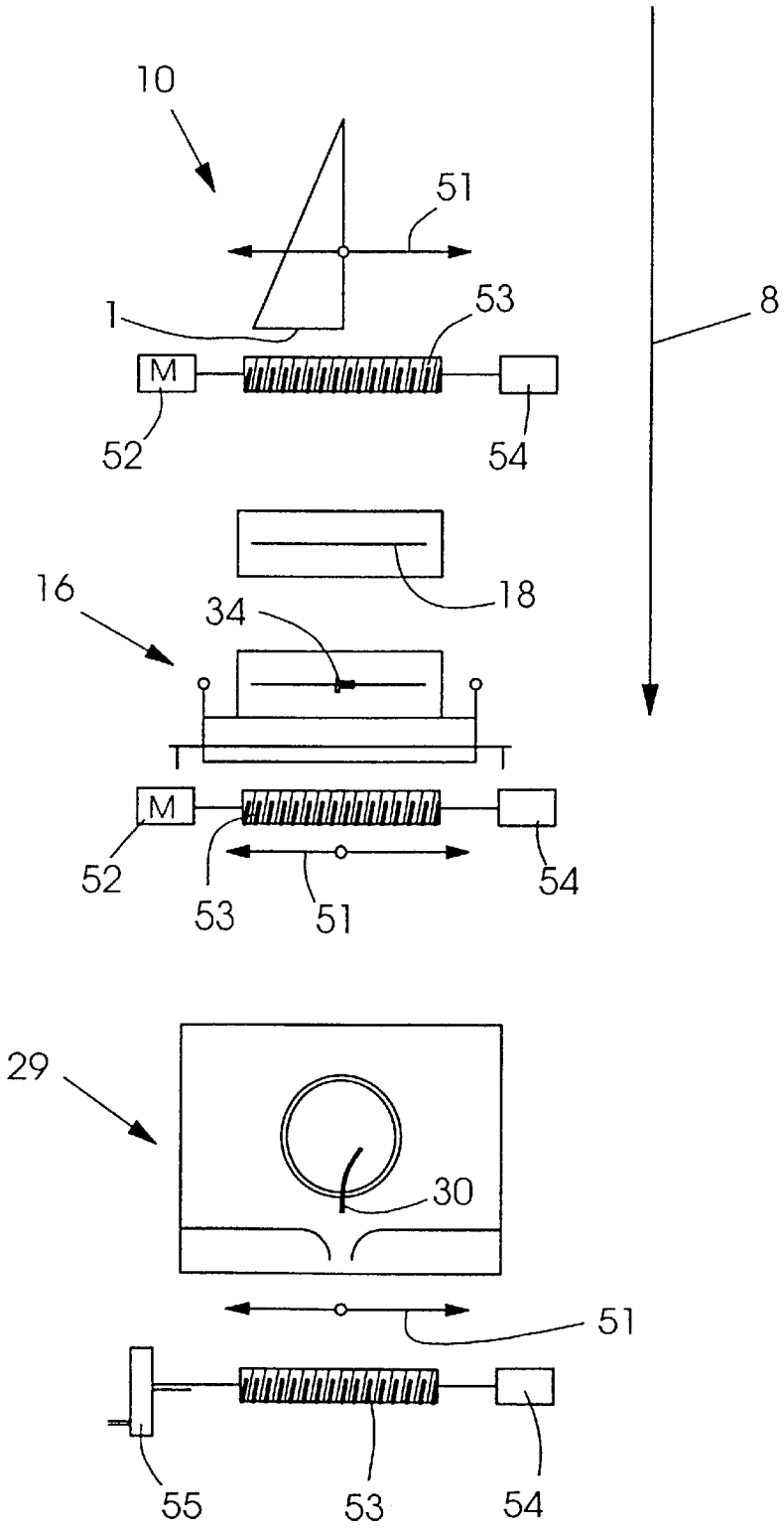
FIG. 7 is a diagrammatic and schematic view of the folder showing the regulation of the perforation position in connection with a first and second longitudinal folding direction with respect to fixedly disposed cutting tools.

Finally, FIG. 7 shows a configuration proposed in accordance with the invention, wherein, for example, the adaptation of the position of the first longitudinal folding device 10, of the further perforating device 12 and of the second longitudinal folding device 29 is performed in relation to a cutting cylinder 18 which is fitted in a stationary position. During the displacement of the position of the fold cut point 43, these components are fed in relation to a cutting cylinder 18, which is mounted in a stationary position, for example, by drives 52 on the first longitudinal folding device 10 and a drive 52 or a handwheel 55 on the second longitudinal folding device 29. The position of the components 10, 16 and 29 in relation to this stationary cutting cylinder 18 may be detected by a rotary encoder 54, which accommodates the drive spindles 53 or a handwheel 55 or the drives 52, by which the components 10, 16 and 29 can be displaced translationally in the direction of the double-headed arrows.

In the case wherein the settings of the components of the first longitudinal fold 10, the further perforating device 16 and the second longitudinal folding device 29 are adjusted automatically, for example, at a job change, the pressman or other operator is relieved of the job of monitoring the relative adjustments of these components in relation to one another; the positions can be indicated at the central control desk of the rotary machine and folder, for example, by LEDs. In addition to spindles 53, slide-like guides or slotted guides or the like may also be used as guides for the components 10, 16 and 29. In the case of folders operating without pins, the belts picking up the signatures 20 instead of pins 22 have to be positioned laterally in such a way that the formation of corners on the signatures 20 is avoided. Within the context of the feeding of the transport belts which grip the signatures 20 in the pinless folder, the aforementioned feeding of the first longitudinal folding device 10 transversely with respect to the web travel direction 8 can be performed. If the first longitudinal folding device 10 is displaced, then the further perforating device 16 is automatically tracked transversely with respect to the web travel direction, in order to match the fold cut point 43 at which the second longitudinal fold is subsequently also located. In addition to a drive 52, a handwheel 55 can also be fitted to the second longitudinal folding device 29, and may, if appropriate, provide the pressman with a manual tracking option for correcting the position of the second longitudinal fold.

We claim:

1. A method of processing signatures separated from a material web stream, including a multilayer material web stream, which comprises the method steps of:

disposing a cutting device with a cutting tool in a region of a first longitudinal fold of the material web stream and a perforating/cutting device with a perforating/cutting tool in a region of a crossfold of the material web stream;

cutting the material web stream in the region of the first longitudinal fold with the cutting device;

perforating/cutting the material web stream in the region of the crossfold with the perforating/cutting device and thereby forming material bridges;

providing that at least one of the cutting tool and the perforating/cutting tool is adjustable in relation to the material web stream; and selectively operating the cutting device and the perforating/cutting device simultaneously and separately from one another.

2. The method according to claim 1, which includes providing that one of the perforating/cutting devices be adjustable in terms of angle of attack in relation to the material web stream.

3. The method according to claim 1, which includes providing that one of the perforating/cutting devices be adjustable in terms of penetration depth in relation to the material web stream.

4. The method according to claim 1, which includes providing that one of the perforating/cutting devices be displaceable in vertical direction in relation to the material web stream.

5. The method according to claim 1, which includes providing that a second perforating/cutting device begin a delayed cutting and perforation operation, respectively, in relation to a first cutting device.

6. The method according to claim 5, which includes providing that a delayed perforation and cutting operation, respectively, be completed by a further perforating/cutting device by generating the first crossfold.

7. The method according to claim 5, which includes detaching established material bridges in the region of the first crossfold during the completion of the folding operation.

8. The method according to claim 7, which includes detaching the material bridges by thrust forces occurring in the interior of the material web stream.

9. The method according to claim 1, which includes providing that the material bridges constitute intended rupture points having a thickness determined by the configuration of the perforating/cutting tool.

10. A device for processing signatures which are separated from a material web stream, including a multilayer material web stream, having a first longitudinal folding device for producing a first longitudinal fold, a possibly provided second longitudinal folding device and a folding cylinder for producing a crossfold, comprising:

a cutting device for cutting the material web stream in a region of the first longitudinal fold; and a perforating/cutting device for perforating/cutting the material web stream in a region of the crossfold;

said first longitudinal folding device, said perforating/cutting device and said possibly provided second longitudinal folding device being movable transversely with respect to a web travel direction by drives, and including contact transmitters for detecting the position thereof.

11. The fold-producing device according to claim 10, wherein said infeedable cutting device accommodates a movable cutting tool.

12. The fold-producing device according to claim 10, wherein said cutting tool is adjustable in terms of the angular position thereof in relation to the material web stream.

13. The fold-producing device according to claim 10, wherein said perforating sections extend over the entire length of said perforating/cutting tool.

14. The fold-producing device according to claim 10, wherein said cutting sections extend over the entire length of said perforating/cutting tool.

15. The fold-producing device according to claim 10, wherein said cutting and perforating sections, respectively, extend halfway along the perforating/cutting tool.

16. The fold-producing device according to claim 10, including a fold cut point on the perforating/cutting tool for determining the position of the second longitudinal fold on the signature.

17. The fold-producing device according to claim 10, wherein cutting surfaces are formed with different lengths in the longitudinal direction of the perforating/cutting tool.

18. The fold-producing device according to claim 10, wherein cutouts formed on said perforating/cutting tool determine the configuration of the material bridges and subsequent intended rupture points on the signature.

19. A folder having a device for processing signatures which are separated from a material web stream, including a multilayer material web stream, having a first longitudinal folding device for producing a first longitudinal fold, a possibly provided second longitudinal folding device and a folding cylinder for producing a crossfold, comprising:

a cutting device for cutting the material web stream in a region of the first longitudinal fold; and a perforating/cutting device for perforating/cutting the material web stream in a region of the crossfold;

said first longitudinal folding device, said perforating/cutting device and said possibly provided second longitudinal folding device being movable transversely with respect to a web travel direction by drives, and including contact transmitters for detecting the position thereof.

20. A pinless folder having a device for processing signatures which are separated from a material web stream, including a multilayer material web stream, having a first longitudinal folding device for producing a first longitudinal fold, a possibly provided second longitudinal folding device and a folding cylinder for producing a crossfold, comprising:

a cutting device for cutting the material web stream in a region of the first longitudinal fold; and a perforating/cutting device for perforating/cutting the material web stream in a region of the crossfold;

said first longitudinal folding device, said perforating/cutting device and said possibly provided second longitudinal folding device being movable transversely with respect to a web travel direction by drives, and including contact transmitters for detecting the position thereof.

21. A method of processing signatures separated from a material web stream, including a multilayer material web stream, which comprises the method steps of:

disposing a cutting device with a cutting tool in a region of a first longitudinal fold of the material web stream and a perforating/cutting device with a perforating/cutting tool in a region of a crossfold of the material web stream;

cutting the material web stream in the region of the first longitudinal fold with the cutting device;

perforating/cutting the material web stream in the region of the crossfold with the perforating/cutting device and thereby forming material bridges;

providing that at least one of the cutting tool and the perforating/cutting tool is adjustable in relation to the material web stream; and providing that the perforating/cutting device begins a delayed perforating/cutting operation in relation to the cutting device.

22. A method of processing signatures separated from a material web stream, including a multilayer material web stream, which comprises the method steps of:

disposing a cutting device with a cutting tool in a region of a first longitudinal fold of the material web stream and a perforating/cutting device with a perforating/cutting tool in a region of a crossfold of the material web stream;

cutting the material web stream in the region of the first longitudinal fold with the cutting device;

perforating/cutting the material web stream in the region of the crossfold with the perforating/cutting device and thereby forming material bridges;

providing that at least one of the cutting tool and the perforating/cutting tool is adjustable in relation to the material web stream; and providing that the material bridges constitute intended rupture points having a thickness determined by the configuration of the perforating/cutting tool.

* * * * *